United States Patent [19]

Kotera et al.

[11] 4,427,365

[45] Jan. 24, 1984

[54] LIQUID FUEL COMBUSTION APPARATUS

[75] Inventors: Takuro Kotera, Kawanishi; Yoshimi Ohmukai, Hirakata; Yoshitaka Kawasaki, Kadoma; Kinichi Adachi, Takarazuka, all of Japan

[73] Assignee: Matsushita Electric Industrial Co., Ltd., Kadoma, Japan

[21] Appl. No.: 254,745

[22] Filed: Apr. 16, 1981

[30] Foreign Application Priority Data

Apr. 17, 1980 [JP] Japan ..... 55-51186
Jun. 16, 1980 [JP] Japan ..... 55-81903

[51] Int. Cl.[3] ..... F23D 5/00

[52] U.S. Cl. ..... 431/196; 431/282; 431/304; 126/96

[58] Field of Search ..... 126/96, 45; 110/263; 431/120, 121, 195, 196, 201, 282, 279, 284, 287, 325, 301, 302, 304–308, 323

[56] References Cited

U.S. PATENT DOCUMENTS 235,439 12/1880 Kistler ..... 431/230
506,243 10/1893 Mast ..... 431/230
596,765 1/1898 Veon ..... 431/230
2,086,885 7/1937 Sherman ..... 431/196
3,251,395 5/1966 Suma ..... 431/279

FOREIGN PATENT DOCUMENTS 775511 11/1980 U.S.S.R. ..... 431/284

*Primary Examiner*—Samuel Scott
*Assistant Examiner*—Noah Kamen
*Attorney, Agent, or Firm*—Cushman, Darby & Cushman

[57] ABSTRACT

A wick assembly for a liquid fuel combustion apparatus is structured by laminating a main wick and an auxiliary wick, and sandwiching a separator of an oil-impermeable material therebetween. By being so structured, the main wick can be made being hardly deteriorated in terms of its calorific value. A material having a large oil containing ability can be selected for the main wick, and distance between the oil level and top of wick can be made shorter. Fire-spreading time of the wick assembly after a lapse of long service period is still as short as that at the beginning of the service, and generation of an objectional odor and carbon monoxide at the time of ignition can be suppressed constantly.

7 Claims, 10 Drawing Figures

101

101

101
102
103

101
102
103

101
102
103
13a
13b
101'

LIQUID FUEL COMBUSTION APPARATUS

BACKGROUND OF THE INVENTION 1. Field of the Invention

The present invention generally relates to a liquid fuel combustion apparatus. Particularly, it is concerned with a wick assembly for combusting liquid fuel in such an apparatus.

2. Prior Art

A liquid fuel combustion apparatus of a type called "wick type" has hitherto been widely embodied as an oil stove, an oil burner and the like. Such an apparatus is usually designed to suction the liquid fuel by capillary action of the wick to lift it up to a top of the wick (i.e. a fuel vaporization part), the surface of which is exposed to an atmosphere of a combustion chamber in the apparatus, wherein the lifted fuel vaporizes to be burnt.

In such kind of the liquid fuel combustion apparatus, since its fuel vaporization part is always exposed to the high temperature atmosphere containing oxygen, a phenomenon, is likely to occur that a part of the fuel contained in the fuel vaporization part becomes a tar-like substance by being oxidized and polymerized to be piled up in the fuel vaporization part. Particularly, the formation and piling-up of said tar-like substance becomes remarkable, if the fuel contains a small amount of high boiling point fractions (for instance, machine oil, light or salad oil is mixed with kerosene), and if part of the fuel is deteriorated (for instance, the kerosene has been caused to contain oxides, peroxides or resinous components as a result of preserving the kerosene at a high temperature or being exposed to the direct daylight for a long period of time).

When the tar-like substance is piled up in the fuel vaporization part, the surface of that part or the capillary tube inside thereof is choked with the substance to obstruct the suctioning and vaporization of the fuel. Due to this phenomena, the vaporization of the fuel is abnormally decreased, to make an air to fuel ratio in the combustion chamber go wrong and to invite an inconvenience of generating a large amount of carbon dust or soot and noxious carbon monoxide. Moreover, this phenomenon of piling up the tar-like substance hinders a rapid rise-up of the temperature of the vaporization part and a rapid increase in the amount of vaporization at start-up time. Thus, it takes the apparatus a remarkably long period of time before reaching to a steady-state combustion and the phenomenon increases the undesirable generations of an objectionable odor, carbon dust and carbon monoxide due to an increased unstable transient-state combustion. In addition, the tar-like substance might stick to both of the wick and a metal part of the apparatus supporting the wick so as to cause them adhered or fixed together, to make the mechanical movement of the wick relative to the metal guiding pipe impossible, and to invite a dangerous state, wherein the turn-off of the apparatus by lowering the wick is made impossible due to such sticking.

As one of the methods for solving the above-mentioned problems, it has hitherto been known to be effective to increase the oil retaining ability of the wick top.

The method can be embodied by the following measure of;

(1) shortening the distance between the oil level and the top of the wick, (2) increasing the thickness of the top, and (3) employing a substance having an oil retaining ability as large as possible for the material of the main wick.

By taking the above-mentioned measure, the deterioration of the fuel vaporization part can be made hardly to occur even if the deteriorated kerosene or the kerosene containing a different kind of component is combusted. In such cases of increasing the oil content in the wick top, the tar-like component generates at the outside of the wick rather than the inside of the wick. As a result, the fuel-suctioning by the main wick is effectively prevented from being made insufficient.

However, when the tar-like substance is formed at the outside of the wick, a fire-spreading time at the start-up of the apparatus is made longer, because the formed tar-like substance makes the heat capacity of the wick top large. If the fire-spreading time is made longer in such way, the objectionable odor at the time of start-up increases and the carbon dust increases accordingly. Therefore, unless the fire-spreading time is shortened, the disadvantages cannot be overcome.

SUMMARY OF THE INVENTION

It is therefore the primary object of the present invention to provide a liquid fuel combustion apparatus capable of shortening the fire-spread time at the start up of the apparatus.

It is another object of the present invention to provide a liquid fuel combustion apparatus capable of suppressing generation of an objectionable odor and carbon dust.

According to the present invention there is provided a liquid fuel combustion apparatus which comprises; a wick assembly of a laminated structure of a main wick, and an auxiliary wick for fire-spreading and at least one separator means sandwiched between said main wick and said auxiliary wick so that it at least partly separates the main wick from the auxiliary wick to prevent permeation of the fuel therethrough.

The auxiliary wick for fire spreading may be disposed at one side of the main wick or sandwiched between bifurcated upper leaves of the main wick. The top of the auxiliary wick may preferably be projected upwards from that of the main wick and the bottom thereof may preferably be lifted up from an oil level during a steady-state combustion.

The thickness of the auxiliary wick for fire-spreading may preferably be smaller than that of the main wick and its fuel-suctioning rate may preferably be smaller than that of the main wick.

BRIEF EXPLANATION OF THE DRAWINGS

FIGS. 4 and 5 are partial enlarged cross-sectional views of the wick assembly as shown in FIG. 3 combined with associated components and parts, indicating positional relation therebetween, wherein FIG. 4 represents a condition at ignition and steady-state combustion and FIG. 5 represents a condition of extinguish operation.

DESCRIPTION OF THE PREFERRED EMBODIMENTS

In the following description, the present invention will be elucidated in more detail by referring to the preferred embodiments shown in the attached drawings.

Figure 1:
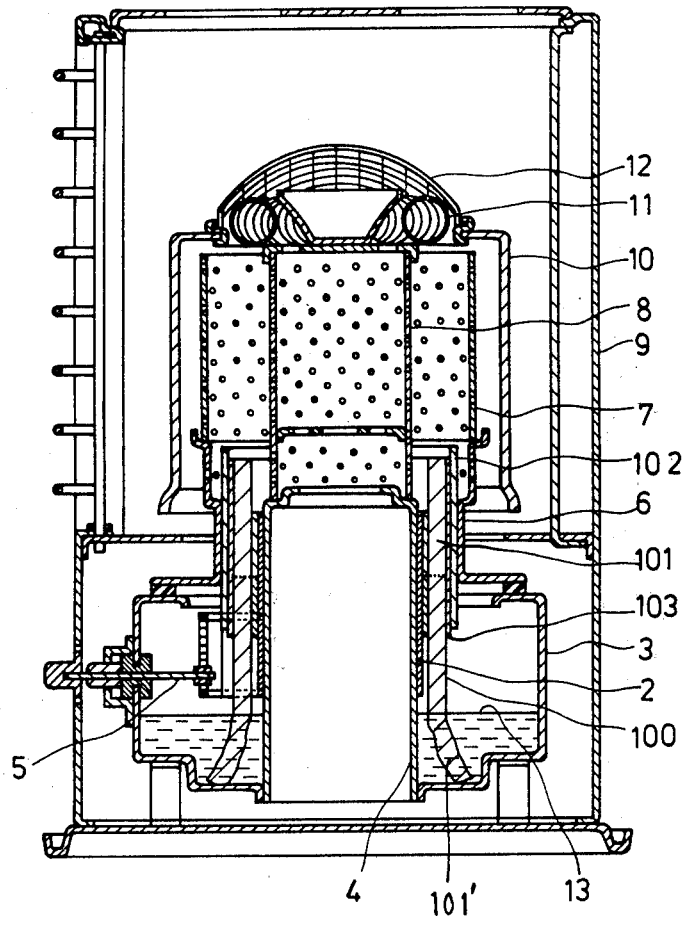
FIG. 1 is a cross sectional view of a liquid-fuel combustion apparatus as an embodiment of the present invention.

FIG. 1 is a general cross-sectional view of a liquid fuel combustion apparatus embodying the present invention. In FIG. 1, components designated by numerals 100, 101, 102 and 103 represent a wick assembly constituting the essential components of the present invention, wherein a main wick 100 serves for suctioning liquid. The main wick 100 may be made of a combustible or noninflammable fabric woven or unwoven (held in shape with a binding agent), and its top forms a fuel combusing part 101. Numeral 102 indicates an auxiliary wick disposed outside of the main wick 100, 101, for facilitating the fire-spreading around top thereof.

Numeral 2 is a wick support, 3 represents a fuel tank or reservoir, 4 is a draft pipe which also serves to vertically guide sliding of the wick assembly 100–103 there along, numeral 5 indicates a wick control unit, i.e., a means for vertically driving the wick assembly, 6 is a wick guide unit, 7 is a radiation grill, 8 indicates an inside tube, 9 is a casing, 10 is chimney support, 11 represents a coil, and 12 a radiation net.

Figure 2:
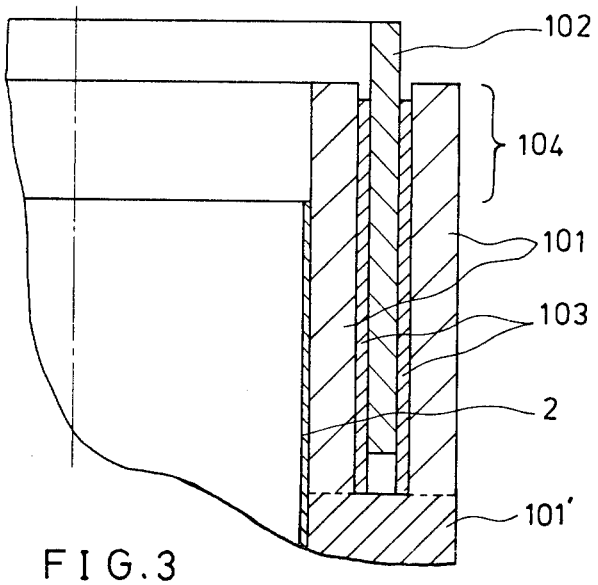
FIG. 2 is a partial enlarged cross-sectional view of a wick assembly used in the embodiment of the present invention.

FIG. 2 is a partial enlarged cross-sectional view of a wick assembly embodying the present invention.

The auxiliary wick 102 is put between two leaves of a bifurcated main wick 101, and the former may be made of a noninflammable fabric, woven or unwoven, and is designed to be thinner, of less oil-containing ability and more heat-resistant, namely, resistant to burn-off, than the main wick 101. The bottoms of the two leaves of the main wick 101 are connected to the upper end of a flexible lower part 101' having a large oil-containing ability.

The top of this auxiliary wick 102 projects upwards from that of the main wick 101, and its projecting length may preferably be at least 50 mm. Although it depends on the oil containing ability and the fuel suctioning rate of the auxiliary wick 102, the bottom may be at a position so selected that the top thereof is always burnt-off during the steady-state of combustion. For example, the bottom of the auxiliary wick 102 of FIG. 2 is disposed with a gap to the upper end of the lower part 101'.

Numeral 103 indicates separators sandwiched between bifurcating leaves of the main wick 101 and the auxiliary wick 102, and made of a material which is impermeable to the fuel and heat-resistant to an extent, such as aluminum foil. The top of the separator(s) 103 is in a region of the fuel vaporization part 104 and its bottom extends downwards at least beneath that of the auxiliary wick 102.

Figure 3:
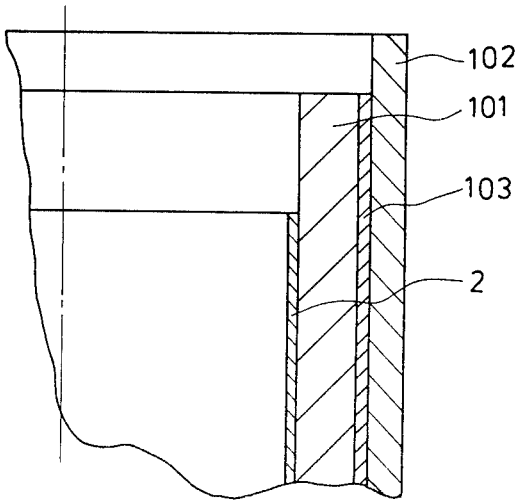
FIG. 3 is a partial enlarged cross-sectional view of a wick assembly used in another embodiment of the present invention.

FIG. 3 shows another embodiment of the present invention wherein the auxiliary wick 102 for fire-spreading is provided outside the main wick 101. The auxiliary wick 102 may alternatively be provided inside the main wick 101.

In the liquid fuel combustion wick assemblies of the above-mentioned drawings, the main wick 101 is at least partly separated from the auxiliary wick 102 by a fuel-impermeable material, and the fuel for the steady-state combustion is suctioned by and ascends through the main wick 101 while the fuel, used in the fire-spreading at the time of ignition, is suctioned solely by the auxiliary wick 102 for the fire-spreading. As a result of such an arrangement, the auxiliary wick for the fire-spreading can be so designed that its top is always burnt-off during the steady-state combustion to prevent the formation of the tar-like substance which would otherwise be produced at the top.

Accordingly, the material and thickness of the auxiliary wick 102 can be selected so that it may have a fuel suctioning rate and an oil-containing ability most suited for a condition of improving the fire-spreading at the time of ignition, without regard to the fuel-suctioning rate and the oil-containing ability of the main wick 101.

On the other hand, the material and thickness of the main wick can be selected from ones of the quality and structure having a high fuel-suctioning rate and a large oil-containing ability with a view to prevent the lowering of the fuel-combusting amount due to the formation of the tar-like substance, without regard to the fire-spreading.

Since each of the wicks performs separate functions as illustrated above, the fire-spreading can be reached to within a short period of time even in the cases wherein the distance from the oil level to the top of the wick is short, and the tar-like substance, which has a nature of inviting the decrease in the amount of the combustion, is piled up at the fuel-combustion part of the main wick in large quantity.

The above-mentioned concept has been confirmed by an experiment conducted for comparing the performances of the wicks of the embodiments of the present invention with that of conventional ones of glass fibre having tapered tops which had hitherto been widely used, whose results are summarized in Table 1 below. In the experiment, a portable oil stove having a wick diameter of 85 mm is used as the combustion apparatus for the fire-spreading test, and a mixed fuel composed of kerosene 50% and light oil 50% is burnt.

TABLE 1

| | Wick assembly | | | | | Fire-spread time (sec) | | |
|---|---|---|---|---|---|---|---|---|
| | Materials | | | | | | | |
| No. | of main wick | of Auxiliary wick | of Separator | Structure | Distance between the oil level and the top of wick (mm) | after using for: 0 hr | after using for: 20 hrs | after using for: 100 hrs |
| 1 | Glass fibre | — | — | Conventional | 90 | 5 | 25 | 120 |
| 2 | " | — | — | Conventional | 135 | 4 | 15 | 90 |
| 3 | Ceramic fibre* ($Al_2O_3$, 52%) ($SiO_2$, 48%) | Silica** cloth | — | laminated | 135 | 4 | 5 | 20 |
| 4 | Ceramic fibre* | Silica** | Aluminum | FIG. 2 | 90 | 4 | 4 | 4 |

TABLE 1-continued

| No. | Wick assembly: Materials: of main wick | of Auxiliary wick | of Separator | Structure | Distance between the oil level and the top of wick (mm) | Fire-spread time (sec): after using for: 0 hr | after using for: 20 hrs | after using for: 100 hrs |
|---|---|---|---|---|---|---|---|---|
| | ($Al_2O_3$, 52%) ($SiO_2$, 48%) | cloth | foil | | | | | |
| 5 | Ceramic fibre* ($Al_2O_3$, 52%) ($SiO_2$, 48%) | Silica** cloth | Aluminum foil | " | 135 | 4 | 4 | 4 |
| 6 | Ceramic fibre* ($Al_2O_3$, 52%) ($SiO_2$, 48%) | Silica** cloth | Aluminum foil | FIG. 3 | 90 | 4 | 4 | 4 |

Note:
*Ceramic fibre: Sheets of several μm filaments of the mixed metal oxides, prepared by paper milling method.
**Silica cloth: Sheet of $SiO_2$ mono-filaments or staples, woven or unwoven.

As indicated in Table 1, the previously mentioned conventional glass fibre wick of tapered top (Nos. 1 and 2) shows a fast fire-spreading at first but this fire-spreading rapidly tends to slow down in a short period of use due to the pile-up of the tar-like substance on its top.

A use of an auxiliary wick 102 of thin silica cloth, which has a small oil containing ability and a small fuel suctioning rate but is heat resistant and durable to burning-off, laminated with the main wick to form a wick assembly No. 3 as listed in Table 1, will reduce the piling-up of the tar-like substance around the top of the auxiliary wick 102 to some extent as compared with that of the glass fibre wick. The piling-up of the tar-like substance will however increase gradually with the lapse of period of use and slows the fire-spreading, due to shifting of the suctioned fuel from the main wick 101 to the auxiliary wick 102 during the combustion.

In contrast to this, if a separator 103 of an oil-impermeable material such as aluminum foil is sandwiched between the main wick 101 and the auxiliary wick 102 of Nos. 4, 5 and 6 in Table 1 and shown in FIGS. 2 and 3, the top of the auxiliary wick 102 is always kept under a condition of being burnt-off to prevent the piling-up of the tar-like substance. By the above burning-off the initial speed of the fire-spreading is effectively maintained, regardless of the time period of use and the distance from the oil-level to the top of the wick, even in the case wherein a large quantity of the tar-like substance is piled-up on the fuel vaporization part 104 of the main wick 101.

In the previously described arrangement of the wick assemblies shown in FIGS. 2 and 3 at least a part of the fuel oil is still evaporating from the auxiliary wick 102 for the fire-spreading during the steady-state combustion. In that state, the main wick 101 is, however, embodied to have a large oil-containing ability and to be able to hardly form the tar-like substance.

Although at the top of the auxiliary wick 102 for the fire-spreading the tar-like substance is hardly formed because the latter is made thin and has a small oil-containing ability, the tar-like substance is yet likely to be formed in the lower portion of the auxiliary wick 102. If this is the case, the evaporation of the fuel from the auxiliary wick for the fire-spreading becomes small to lead a decrease in the amount of fuel combusiton to that extent. The percentage of this decrease is, however, very small as compared with that of the conventional structure.

Even in the arrangement of the wick assembly having the auxiliary wick 102 of the aforementioned structure, if a kerosene containing small amount of high boiling point fraction or oil of foreigh kind, which is essentially very hard to be vaporized at a temperature to vaporize the kerosene, is combusted, then the fire-spreading is still unacceptably slow to lead a self-extinguish phenomenon (fire is going out).

In order to solve these problems, it is desirable to embody the wick assembly, so that the bottom of the auxiliary wick 102 is below the oil level at the extinguishing operation but positions above the oil level during the combustion in the arrangement essentially the same as described above.

By so embodying, the auxiliary wick 102 contains oil only at the time of igniting and is always in the condition of burnt-off during the steady-state of combustion, and hence no decrease occurs in the amount of the combustion, and no defective ignition attributable to the auxiliary wick 102 occurs.

In the following paragraph, the arrangement will be elucidated in more detail by referring to the attached drawings.

Figure 4:
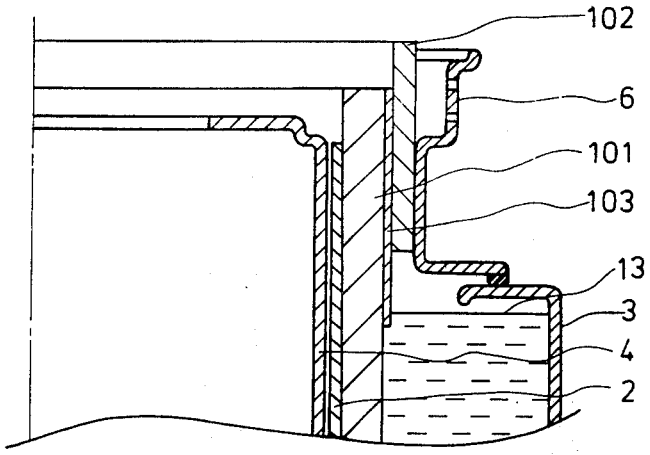
Figure 5:
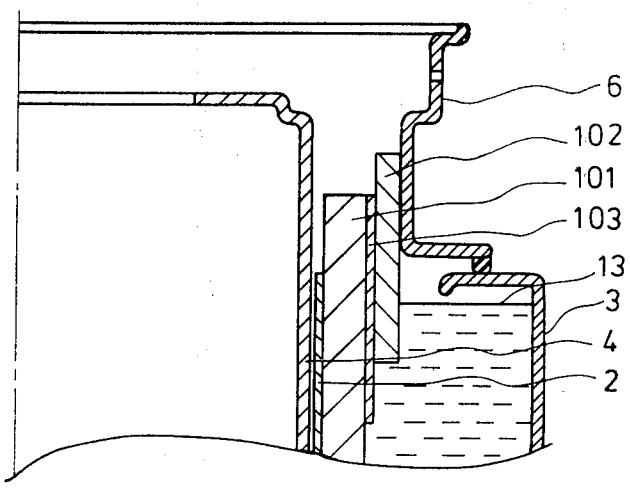

In FIGS. 4 and 5, a main wick 101 made of combustible or noninflammable fabric is held in its shape by weaving or by adhering with a binding agent, and comprises a fuel-vaporization part 104 being above a top of a wick-supporter 2 (a metal pipe) and a fuel-suctioning part 100 being beneath the top of the wick-supporter 2. The main wick 101 is made of a material having a large fuel-containing ability and a high fuel-suctioning rate, in order to suppress the decrease in the amount of the fuel combustion.

An auxiliary wick 102 for fire-spreading is made of noninflammable fabric woven or held in its shape unwoven, having an oil containing ability just sufficient for shifting the fire to the main wick 101 after the fire-spreading is completed and being of a heat-resistant durable to the burning-off. It is more effective for the purpose if the fuel-suctioning rate of the auxiliary wick 102 is made smaller than that of the main wick 101. Furthermore, the top of the auxiliary wick 102 projects upwards from that of the main wick 101 and its bottom is designed to be lift up at least 10 mm above the oil level 13 during the steady-state of the combustion (FIG. 4). A separator 103 sandwiched between the main wick 101 and the auxiliary wick 102 is made of a material impermeable to the fuel and heat-resistant to some extent such as aluminum foil, and the top thereof extends at least above the top of the main wick 101 and its bottom extends downwards beneath the bottom of the auxiliary wick 102.

FIGS. 4 and 5 show the situation wherein the wick assembly shown by FIG. 3 is installed in a practical combustion apparatus, and FIG. 4 indicates a mode of the steady-state combustion and FIG. 5 indicates an extinguishing (turning off) mode. As illustrated in FIG. 4, since the bottom of the auxiliary wick 102 is lifted up from the oil level 13 during the steady-state combustion, no fuel is suctioned by the auxiliary wick 102, and the auxiliary wick 102 is caused to be soaked in the oil to be impregnated with oil only in the extinguishing mode.

In the above indicated embodiment, since the main wick 101 is separated from the auxiliary wick 102 by the oil-impermeable separator 103, the fuel to be vaporized is suctioned through the main wick 101 whereas that of an amount as much as necessary for the fire-spreading is suctioned through the auxiliary wick 102 and supplied to its top.

By adopting the above-mentioned configuration, a material and a structure having a large oil-containing ability and a high fuel-suctioning rate can be selected as that for the main wick 101 in order to suppress the decrease in the amount of combustion, without taking any regard of the fire-spreading. On the other hand, as the material of the auxiliary wick 102 and as its top thickness, it is possible to select those having an oil-containing ability just sufficient for maintaining the fire during its spreading around the top of the auxiliary wick 102 and to transfer the fire to the main wick, and being in a state of completely burnt-off in the steady-state combustion and free from the piling-up of the tar-like substance.

Next, an experiment is conducted in order to compare the wicks (FIGS. 8, 9 and 10) of the embodiments of the present invention with the conventional wicks (FIGS. 6 and 7) of glass fibre having thinned top, and its results are summarized in Table 2 below. In the experiment, a portable oil stove having a wick diameter of 85 mm is used as the combustion apparatus for the test, wherein the performance of the wicks in terms of fire-spreading time, fire-taking and calorific value-maintaining characteristics are measured with kerosene containing 0.05% of salad oil which is intentionally mixed into the fuel in order to make it liable to produce the tar-like substance during the test. The distance from the oil-level to the top of the wick is 90 mm and the initial calorific value of the apparatus is set at approximately 2100 kcal.

Figures 6, 7, 8, 9, 10:
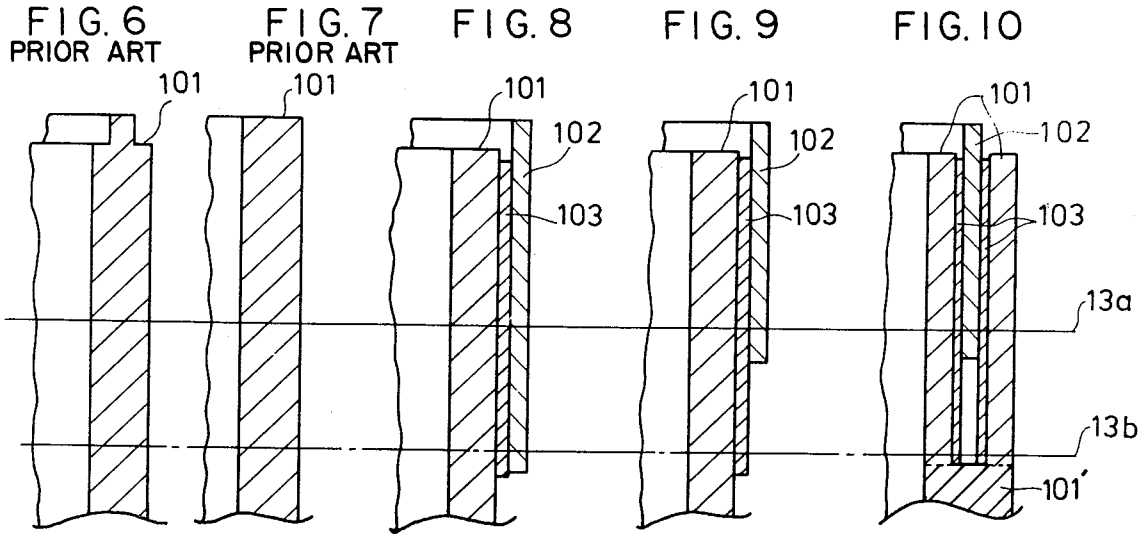
FIG. 6 PRIOR ART
FIG. 7 PRIOR ART
FIGS. 6–10 are cross-sectional views of various wicks embodying the present invention as contrasted to those of prior arts.

The relationship between, the tested wick assemblies of the embodiments and the comparative wicks, and the oil level is shown in FIG. 6, wherein numeral 101 indicates the main wick, 102 indicates the auxiliary wick for the fire-spreading and 103 indicates the separator. The oil level during the steady-state combustion is represented by 13*b*, and that at the extinguish, when the wick is lowered, is represented by 13*a*.

TABLE 2

| | Material | | | Structure in FIG. 6 | After being used | | | | | | | |
|---|---|---|---|---|---|---|---|---|---|---|---|---|
| | | | | | for 0 hr. | | for 10 hrs. | | for 20 hrs. | | for 30 hrs. | |
| No. | Main wick 1 | Auxiliary wick 2 | Separator 3 | | Calorific value (%) | Fire-spreading time (sec) | Calorific value (%) | Fire-spreading time (sec) | Caloric value (%) | Fire-spreading time (sec) | Caloric value (%) | Fire-spreading time (sec) |
| 7 | Glass fibre | — | — | (a) | 100 | 4 | 75 | 4 | 60 | 4 (partly went out) | 50 | Failed to ignite |
| 8 | Glass fibre | — | — | (b) | 100 | 5 | 85 | 25 | 76 | 50 | 60 | 120 |
| 9 | Ceramic fibre $Al_2O_3$ 52% $SiO_2$ 48% | Silica cloth (1 mm, thickness) | Aluminum foil | (c) | 100 | 4 | 88 | 15 | 84 | 25 | 80 | 25 (partly went out) |
| 10 | Ceramic fibre $Al_2O_3$ 52% $SiO_2$ 48% | Silica cloth (1 mm, thickness) | Aluminum foil | (d) | 100 | 4 | 96 | 6 | 90 | 6 | 84 | 6 (partly went out) |
| 11 | Ceramic fibre $Al_2O_3$ 52% $SiO_2$ 48% | Silica cloth (1.5 mm thickness) | Aluminum foil | (d) | 100 | 5 | 95 | 5 | 90 | 6 | 84 | 6 |
| 12 | Glass fibre | Silica cloth (1.5 mm thickness) | Aluminum foil | (d) | 100 | 5 | 88 | 5 | 83 | 6 | 74 | 6 |
| 13 | Ceramic fibre $Al_2O_3$ 52% $SiO_2$ 48% | Silica cloth (1.5 mm thickness) | Aluminum foil | (e) | 100 | 5 | 94 | 5 | 90 | 6 | 84 | 6 |

In Table 2 above, it is shown that the wick No. 7 of the compared devices has a good fire-spreading time as short as 4 seconds, during 20 hrs. of service from the beginning of the test, but the fire partly goes out at about 20 hrs. from the beginning and totally fails to ignite the wick by 30 hrs. after the beginning. This phenomenon is attributable to the fact that, although the fire-spreading at the top of the wick 101 is imporved by thinning the top portion, the tar-like substance is piled up on a thick portion of the wick in a short period of service. Furthermore, since the top of the wick is thin, a deterioration in the calorific value is great and an objectionable odor becomes strong when the deterioration exceeds 30%.

On the other hand, since the wick No. 8 of the comparative devices has a large oil-containing ability even at its top, its deterioration in the calorific value is small as compared with the wick No. 7, but its fire-spreading time rapidly becomes long. This is also due to the piling-up of the tar-like substance at the top of the wick 101, and when the fire-spreading time becomes as long as 20–50 sec., the carbon dust and the objectionable odor are generated in a large quantity at the time of fire-setting.

Since the auxiliary wick 102 for fire-spreading is separated from the main wick 101 by the separator 103 in the structure listed in No. 9 of the embodiments, very good results in both respect of the calorific value and the fire-spreading time are obtained with this wick assembly as compared with the wicks No. 7 and No. 8 of the comparative devices, by virtue of the selective uses of material having a large oil-containing ability for the main wick 101 and that having a thin top for the auxiliary wick 102.

The wick assembly of this structure presents only scarce problems even in the test performed by using kerosene containing components having a slightly larger molecular weight such as light oil as used for the wicks 3–6 listed in Table 1. However, the fire-spreading time with the lapse of the service time when it is tested becomes long, when using kerosene containing a component like salad oil which is the most hardly vaporizable. The wicks listed as Nos. 10–13 of the embodiments in Table 2 are embodied so that the bottom of the auxiliary wick 102 is lifted up from the oil level in the steady-state combustion, and therefore they do not produce any tar-like substance which would otherwise be piled up on the auxiliary wick. They always show a good fire-spreading time as short as in the beginning of the service and produce no objectional odor or carbon dust at the time of ignition.

What is claimed is:

1. A liquid fuel combustion apparatus which comprises: a wick assembly of a laminated structure having a main wick, an auxiliary wick for fire-spreading, the bottom of which is disposed at a position below the surface of the oil and is to be lifted up from the oil surface during a steady-state combustion, and at least one separator means partly sandwiched between said main wick and said auxiliary wick to separate said main wick from said auxiliary wick for preventing permeation of fuel therethrough.

2. A liquid fuel combustion apparatus as claimed in claim 1, wherein the bottom of said auxiliary wick is disposed at a position below the surface of the oil and is to be lifted up from the oil surface during a steady-state combustion.

3. A liquid fuel combustion apparatus as claimed in claim 1, wherein said auxiliary wick for fire-spreading is disposed at one side of said main wick.

4. A liquid fuel combustion apparatus as claimed in claim 1, wherein said main wick is bifurcated upwards forming bifurcated leaves and said auxiliary wick for fire-spreading is put between said bifurcated leaves of said main wick.

5. A liquid fuel combustion apparatus as claimed in claim 1, wherein the thickness of said auxiliary wick for fire-spreading is smaller than that of said main wick.

6. A liquid fuel combustion apparatus as claimed in claim 1, wherein the fuel suctioning rate of said auxiliary wick for fire-spreading is smaller than that of said main wick.

7. A liquid fuel combustion apparatus as claimed in claim 1, wherein the top of said auxiliary wick for fire-spreading is projected upwards from that of said main wick.

* * * * *